US005996673A

United States Patent [19]

Iban et al.

[11] Patent Number: 5,996,673

[45] **Date of Patent: *Dec. 7, 1999**

[54] HEADER TAPE FOR CURTAINS AND THE LIKE

[75] Inventors: Satiago E. Rosa Iban, Tarrasa; Miguel Ferrero Sanche, Granollera; Cesar Casas Grino, Tarragona, all of Spain; Takashi Hasegawa, Frodsham, United Kingdom; Toru Yamamoto, Meerbusch, Germany

[73] Assignees: YKK Europe Limited, London, United Kingdom; Industrias Murta S.A., Barcelona, Spain

[ * ] Notice: This patent issued on a continued prosecution application filed under 37 CFR 1.53(d), and is subject to the twenty year patent term provisions of 35 U.S.C. 154(a)(2).

[21] Appl. No.: 08/861,662

[22] Filed: May 22, 1997

[30] Foreign Application Priority Data

May 22, 1996 [GB] United Kingdom ..... 9610744

[51] Int. Cl.[6] ..... A47H 13/14

[52] U.S. Cl. ..... 160/348; 160/DIG. 7

[58] Field of Search ..... 160/348, 330, 160/123, 124, 126, 84.01, DIG. 7

[56] References Cited

U.S. PATENT DOCUMENTS

| | | | |
|---|---|---|---|
| 2,159,733 | 5/1939 | French | 160/348 X |
| 2,159,734 | 5/1939 | French | 160/348 X |
| 2,985,235 | 5/1961 | Landell | 160/348 |
| 3,011,174 | 12/1961 | Schaerer | 160/348 |
| 3,335,762 | 8/1967 | Noyel | 160/348 X |
| 3,741,259 | 6/1973 | Wood et al. | 160/348 X |
| 3,774,666 | 11/1973 | Bunger | 160/348 |
| 3,963,067 | 6/1976 | Scholer | 160/348 |
| 4,655,272 | 4/1987 | Reilly et al. | 160/348 |
| 5,415,916 | 5/1995 | Giese | 160/348 X |

FOREIGN PATENT DOCUMENTS

| | | | |
|---|---|---|---|
| 327339 | 8/1989 | European Pat. Off. . | |
| 583081 | 2/1994 | European Pat. Off. . | |
| 612493 | 8/1994 | European Pat. Off. . | |
| 645112 | 3/1995 | European Pat. Off. . | |
| 2685926 | 7/1993 | France . | |
| 1239824 | 12/1964 | Germany . | |
| 9109888 | 1/1992 | Germany . | |
| 962775 | 7/1964 | United Kingdom | 160/348 |

*Primary Examiner*—David M. Purol
*Attorney, Agent, or Firm*—Ostrolenk, Faber, Gerb & Soffen, LLP

[57] ABSTRACT

A header tape for curtains or the like has loops for a hook and loop fastener woven at discrete, spaced apart regions. The loops are formed from the warp threads. The back of the tape is coated only in the regions, for fixing the loops, so that the intervening regions remain flexible for gathering. Gathering cords are of a material which will not be adhered to by the adhesive.

4 Claims, 2 Drawing Sheets

HEADER TAPE FOR CURTAINS AND THE LIKE

BACKGROUND OF THE INVENTION

1. Field of the Invention

The present invention relates to a header tape for curtains and the like. Header tapes are attached to the upper edge of a curtain, or other hanging material, to receive hooks for hanging the curtain and to form pleats in the curtain or gather it.

To form a pleat or a gather, parallel cords run through the length of the tape and, with the tape attached to a curtain, are pulled through from one end to bunch up the body of the tape. The cords are incorporated in the tape in the warp direction during the weaving of the tape, and have a substantially greater diameter than the warp threads.

2. Description of the Related Art

Hook and loop fasteners have been used in systems for hanging curtains. In one such system, described in EP-A-612,493, a strip of loop material is attached to the top of the curtain. The curtain hooks, for hanging the curtain from a rail, have a plate-like surface with hooks moulded on it for engagement with the loops of the header tape. These systems are particularly useful for industrial purposes when curtains are to be removed frequently or with the minimum of effort. However, one drawback is the need for a gather tape in addition to the strip of loop material.

FR-A-2 685 926 shows a gather tape into which the loops, of a hook and loop fastener system, have been woven into the tape during manufacture of the tape. The loops are formed using a weft yarn, which is passed over bars which extend in the warp direction. Regions of loops are formed, spaced apart along the length of the tape. Also the regions may be staggered across the width of the tape.

SUMMARY OF THE INVENTION

A first aspect of the present invention provides a header tape for a curtain or the like, having a plurality of loops for a hook and loop fastener woven into the tape, wherein the loops are formed by a thread running in the warp direction.

By forming the loop from a thread running in the warp direction, the loop adopts a higher profile, ie it stands more proud, than a loop formed by a thread running in the weft direction.

Preferably the tape is treated to fix the loops against being pulled. This can be done, for example, by coating the back of the tape with adhesive, as is generally known in the art of forming loop material.

Preferably the loops are formed in discrete regions which are spaced apart in the warp or length direction of the tape.

The regions where the loops are fixed by adhesive, etc., tend to be relatively stiff. By forming the loops in discrete regions, and treating only the regions of the loops, the regions between the loops remain relatively flexible and can be gathered up with ease.

Preferably one or more gather cords are woven into the tape. Very preferably, the material of the cord and the main body of the tape are different.

By forming the body of the tape with a first material which has an affinity for the adhesive or coating, and the cord of a second material which does not, it is possible to coat the loop regions without bonding the cord to the body of the tape-hence the cord can still be drawn easily through the tape.

A second aspect of the invention provides a header tape for a curtain or the like, having loops for a hook and loop fastener woven into the tape, the tape being coated to fix the loops against pulling, and a cord extending through the tape for gathering it, wherein the cord is formed from a material which is not adhered to by the coating.

The cord may have a surface coating which will not adhere to the coating for fixing the loops.

DETAILED DESCRIPTION OF THE INVENTION

Figure 1:
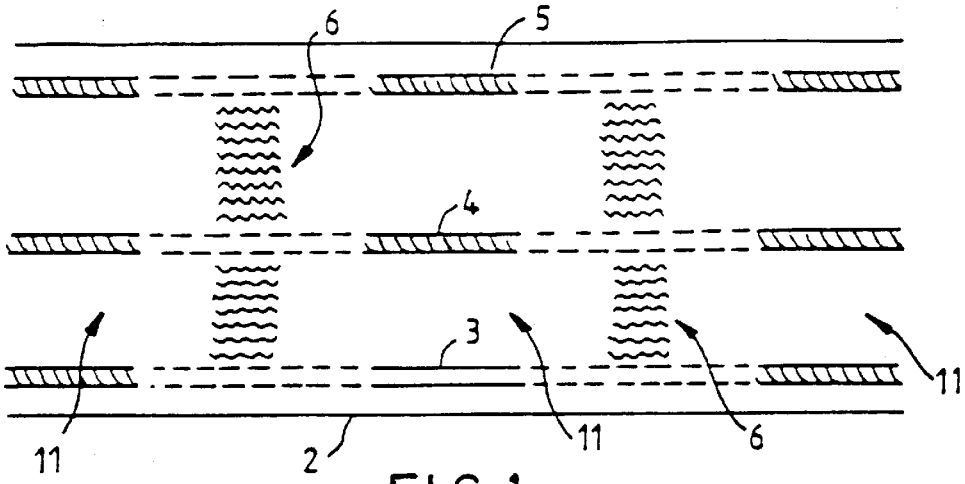
FIG. 1 is a plan view of a header tape forming a first embodiment of the invention.

FIG. 1 shows a curtain header tape 2 woven on a needle loom for making tapes. The tape has cords 3, 4, 5 which extend along its length and can move freely relative to the body of the tape 2, for gathering it.

Regions 6 of loops are formed at spaced apart intervals along the tape. Each region 6 extends across substantially the full width of the tape between the outer cords 3, 5 and is interrupted at the centre cord 4.

The loops of the loop regions 6 are formed from threads 9 running in the warp direction.

Figure 4:
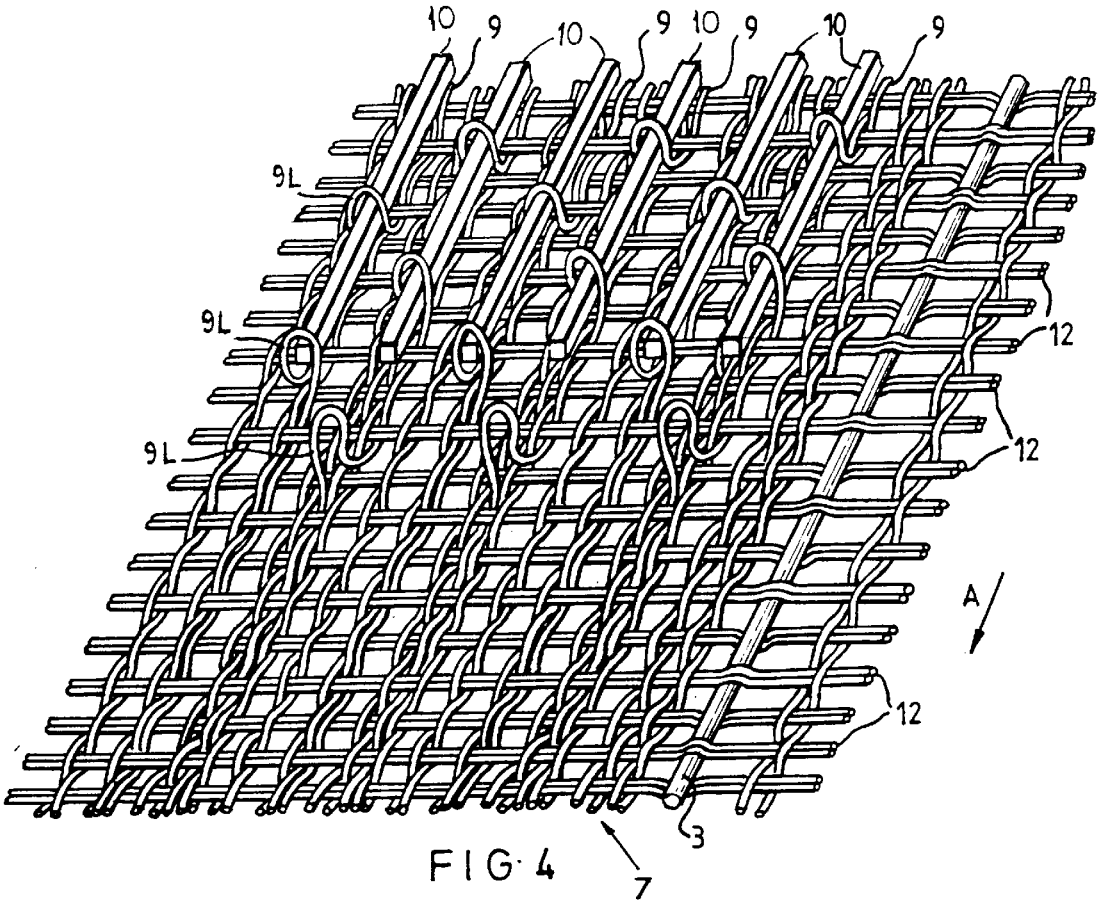
FIG. 4 illustrates a method of weaving loops using a warp thread.

FIG. 4 shows a detail of a tape section, with a cord 3 at one edge 7. Warp threads 9 are formed into loops 9L by passing the threads laterally backwards and forwards across bars 16 which extend in the warp direction, from the region of the loom batten. On some warp threads, which are marked by reference numeral 9, successive loops formed one after the other in the warp direction, and are spaced part by a few picks or groups of weft threads 12. The tape, in FIG. 4, is moving in the direction of the arrow A.

To provide non-loop regions 11, the thread 9 is not moved laterally across the bar 10 but continues on as a warp thread.

After weaving, the back of the tape, at the loop regions 6, is coated with an adhesive coating to fix the warp threads 9 relative to the weft threads 12, to prevent pulling of the warp threads 9 in use.

Preferably the material of the warp and weft threads is nylon, and the tape is coated with an adhesive such as a synthetic resin. The cord 3, 4, 5 is of polyester, and an adhesive which will adhere to nylon, but not to polyester, is chosen.

Figure 5:
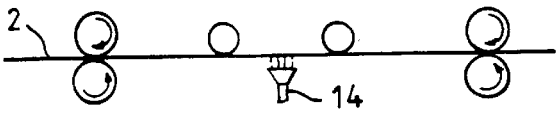
FIG. 5 illustrates a method of coating a tape.

FIG. 5 illustrates schematically a spray system for coating the back of the tape, the spray 14 being operated as the loop regions 6 pass above it. The spray can coat the full width of the tape without fear of bonding the polyester cords 3, 4, 5 in place. The coating may be applied to the back of the tape at the loop regions in other ways, for example using a roller.

Figure 2:
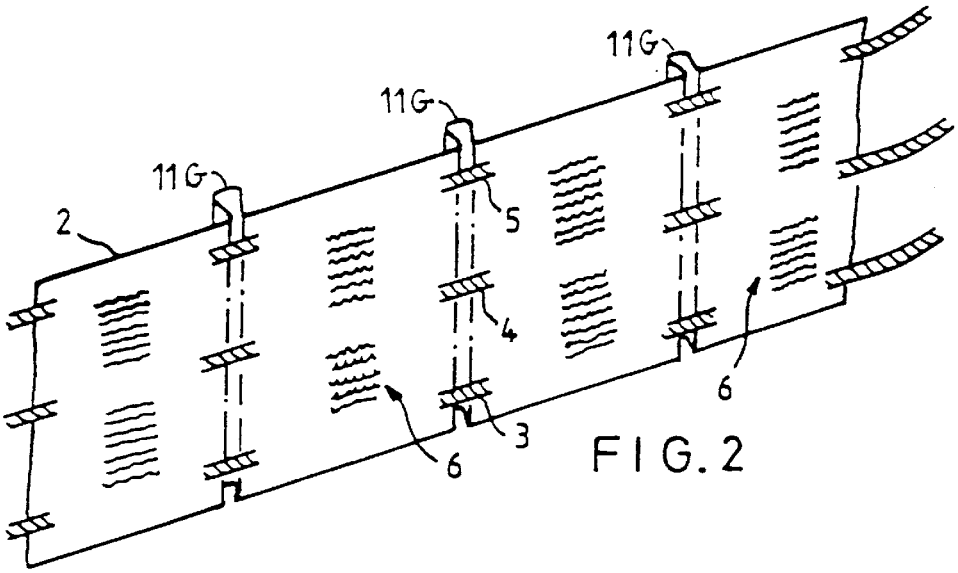
FIG. 2 shows the tape of FIG. 1 gathered.
Figure 3:
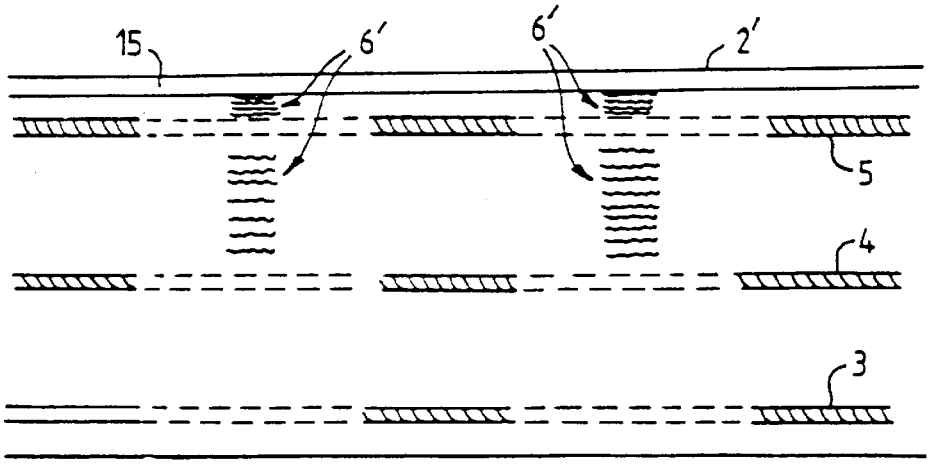
FIG. 3 shows a second embodiment of the invention.

FIG. 2 shows the tape 2 with the cords 3, 4, 5 pulled through to gather or bunch the tape at the non-loop regions 11. The loop regions 6 occupy only part of the tape length between the gathers or non-loop regions formed by the non-loop regions. 11. The loop regions are positioned so that they will be a predetermined spacing apart, typically 4 to 12 cm. center to center, in the gathered tape. This makes it easier to locate the cooperating curtain hangers or hooks at regular intervals along the gathered tape In FIG. 3, the tape 2' has loop regions 6' formed only on one half of the tape, a selvedge region 15 also being shown.

We claim:

1. A header tape for a curtain, said header tape woven of warp and weft threads and having a plurality of loops for a hook and loop fastener woven into said header tape, said loops being formed by some of said warp threads in discrete regions defining thereof loop regions which are spaced apart at regular intervals along said header tape with non-loop regions situated between said loop regions, said tape being treated with a coating of adhesive only at said loop regions to prevent pulling of the loops in use, said tape being gatherable at spaced apart non-loop regions to form pleats, said loop regions extending along the tape for only a part of the length between said spaced apart non-loop regions, whereby when the tape is gathered the loop regions are spaced apart along the gathered tape.

2. A header tape for a curtain, the tape having first warp threads and second warp threads running in the lengthwise direction and weft threads in the transverse direction, said first warp threads running continuously axially of said tape, and said second warp threads formed into transverse loops in discrete regularly axially spaced regions of said tape, adhesive means securing said second warp threads to weft threads only in said discrete regions, said tape being gatherable by pulling said first warp threads axially which threads are freely movable axially within said tape thereby causing said second warp threads to pull and form the tape into pleats created by said discrete regions, wherein said second warp threads and said weft threads comprise nylon, said first warp threads comprises polyester, and said adhesive adheres the nylon threads to each other and does not adhere to said polyester threads.

3. A header tape according to claim 2 wherein said second warp threads and said weft threads comprise a woven fabric, and said first warp threads are slidable through said fabric in said lengthwise warp direction.

4. A header tape according to claim 3 wherein said loops are situated only on one side of said fabric.

* * * * *